US009671127B2

(12) United States Patent
Mercer et al.

(10) Patent No.: US 9,671,127 B2
(45) Date of Patent: Jun. 6, 2017

(54) MULTI-POISE CONDENSATE DRAIN PAN

(71) Applicant: Carrier Corporation, Farmington, CT (US)

(72) Inventors: Kevin Mercer, Danville, IN (US); Barry W. Lee, Greenwood, IN (US); Alice R. Walker, Plainfield, IN (US)

(73) Assignee: Carrier Corporation, Jupiter, FL (US)

( * ) Notice: Subject to any disclaimer, the term of this patent is extended or adjusted under 35 U.S.C. 154(b) by 245 days.

(21) Appl. No.: 14/505,315

(22) Filed: Oct. 2, 2014

(65) Prior Publication Data

US 2015/0153064 A1 Jun. 4, 2015

Related U.S. Application Data

(60) Provisional application No. 61/911,913, filed on Dec. 4, 2013.

(51) Int. Cl.
*F25D 21/14* (2006.01)
*F24F 13/22* (2006.01)
*F24F 1/00* (2011.01)

(52) U.S. Cl.
CPC ..... *F24F 13/22* (2013.01); *F24F 1/0007* (2013.01)

(58) Field of Classification Search
CPC .. F24V 13/22; F24V 13/222; F24V 2013/221; F24V 2013/227; F28F 17/005
See application file for complete search history.

(56) References Cited

U.S. PATENT DOCUMENTS

| | | | | |
|---|---|---|---|---|
| 5,697,227 | A | 12/1997 | Bruce et al. | |
| 6,168,248 | B1 | 1/2001 | Timmons et al. | |
| 6,978,909 | B2 | 12/2005 | Goetzinger et al. | |
| 7,003,972 | B2 | 2/2006 | Eom et al. | |
| 7,185,513 | B2 | 3/2007 | Bush et al. | |
| 7,669,641 | B2 | 3/2010 | Rembold et al. | |
| 7,878,019 | B2 | 2/2011 | Cantolino | |
| 2005/0109053 | A1* | 5/2005 | Eom | F24F 1/0007 62/285 |
| 2005/0109055 | A1* | 5/2005 | Goetzinger | F24F 13/222 62/291 |
| 2007/0169501 | A1* | 7/2007 | Rios | F24F 13/222 62/286 |
| 2011/0265508 | A1 | 11/2011 | Piccione | |
| 2013/0008526 | A1 | 1/2013 | Rowland | |

* cited by examiner

*Primary Examiner* — Elizabeth Martin
(74) *Attorney, Agent, or Firm* — Ice Miller LLP

(57) ABSTRACT

A condensate drain pan including an inner front wall, an inner back wall and opposed inner side walls defining an inner perimeter, at least one outer front wall, an outer back wall and opposed outer side walls defining an outer perimeter. The condensate drain pan further includes at least one drain pan panel extending between the inner perimeter and the outer perimeter, at least one drain opening disposed in the outer front wall, and at least one coil conduit aperture disposed in the outer front wall configured to allow at least one coil conduit to be inserted therethrough.

35 Claims, 7 Drawing Sheets

MULTI-POISE CONDENSATE DRAIN PAN

CROSS REFERENCE TO RELATED APPLICATIONS

The present application is related to, and claims the priority benefit of, U.S. Provisional Patent Application Ser. No. 61/911,913 filed Dec. 4, 2013, the contents of which are hereby incorporated in their entirety into the present disclosure.

TECHNICAL FIELD OF THE DISCLOSED EMBODIMENTS

The presently disclosed embodiments generally relate to appliances for heating and cooling air, and more particularly, to a multi-poise condensate drain pan.

BACKGROUND OF THE DISCLOSED EMBODIMENTS

In a conventional refrigerant cycle, a compressor compresses a refrigerant and delivers the compressed refrigerant to a downstream condenser. From the condenser, the refrigerant passes through an expansion device, and subsequently, to an evaporator. The refrigerant from the evaporator is returned to the compressor. In a split system heating and/or cooling system, the condenser may be known as an outdoor heat exchanger and the evaporator as an indoor heat exchanger, when the system operates in a cooling mode. In a heating mode, their functions are reversed.

In the split system, the evaporator may be part of a fan coil assembly. A typical fan coil assembly includes an evaporator coil (e.g., a coil shaped like a "V", which is referred to as an "V-coil") and a condensate drain pan disposed within a casing. A V-coil may be referred to as a "multi-poise" coil because it may be oriented either horizontally or vertically in the casing of the fan coil assembly.

During a cooling mode operation, a blower circulates air through the casing of the fan coil assembly, where the air cools as it passes over the evaporator coil. The blower then circulates the air to a space to be cooled.

Typically, a refrigerant is enclosed in piping that is used to form the evaporator coil. If the temperature of the evaporator coil surface is lower than the dew point of air passing over it, the evaporator coil removes moisture from the air. Specifically, as air passes over the evaporator coil, water vapor condenses on the evaporator coil. The condensate drain pan of the evaporator assembly collects the condensed water as it drips off of the evaporator coil. The collected condensation then typically drains out of the condensate drain pan through at least one of two drain holes in the condensate drain pan. Typically, the refrigerant connections to the evaporator coil penetrate the casing of the fan coil assembly requiring additional assemblies, for instance a door, to be removed in order to gain access to the evaporator coil when service is required. These additional assemblies are an inconvenience to maintenance personnel and add cost to the fan coil assembly. There is, therefore, a need to enable access to the evaporator coil without the need for additional assemblies.

SUMMARY OF THE DISCLOSED EMBODIMENTS

In one aspect, a condensate drain pan is provided. The condensate drain pan includes an inner front wall, an inner back wall, and opposing inner side walls defining an inner perimeter. In one embodiment, the condensate drain pan further includes at least one outer front wall, an outer back wall, and opposing outer side walls defining an outer perimeter. In at least one embodiment, each opposing outer side wall includes a channel portion extending from the channel portion. In one embodiment, the condensate drain pan further includes at least one drain pan panel, including a panel interior side and a panel exterior side, extending between the inner perimeter and the outer perimeter to form at least one condensate channel. In at least one embodiment, a front drain pan panel may extend between the inner front wall and the outer front wall to form a front condensate channel. In at least one embodiment, a back drain pan panel may extend between the inner back wall and the outer back wall to form a back condensate channel. In at least one embodiment, a first side drain pan panel may extend between one of the opposing inner side walls and one of the opposing outer side walls to form a first side condensate channel. In at least one embodiment a second side drain pan panel may extend between the other opposing inner side wall and the other opposing outer side wall to form a second side condensate channel. In at least one embodiment, the at least one drain panel extends from a portion of the channel portion to form a lip. In at least one embodiment, at least one tab may extend the lip to the first side drain panel exterior side.

In one embodiment, the at least one outer front wall includes at least one coil conduit aperture disposed therein. In one embodiment, the condensate drain pan further includes at least one drain opening disposed in the at least one outer front wall. In one embodiment, the at least one drain opening includes at least one drain aperture substantially aligned with the first side condensate channel. In one embodiment, the at least one drain opening includes at least one drain aperture substantially aligned with the second side condensate channel. In one embodiment, the at least one drain opening includes at least one drain aperture substantially aligned with the front condensate channel.

In one aspect, a fan coil assembly is provided. In one embodiment, the fan coil assembly includes a coil disposed within a casing. In one embodiment, the coil includes at least one coil slab and at least one coil conduit disposed within and protruding from the at least one coil slab. In one embodiment, the fan coil assembly further includes the condensate drain pan positioned to receive at least a portion of condensate from the coil. In one embodiment, the fan coil assembly further includes a fan disposed within the casing. In one embodiment, the fan coil assembly further includes an auxiliary heating assembly operably coupled to the casing.

In one aspect, a heating, ventilation, and air-conditioning (HVAC) system is provided. In one embodiment, the HVAC system includes a fan coil assembly operably coupled to a heat pump, wherein the fan coil assembly includes a condensate drain pan positioned to receive at least a portion of condensate from a coil

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
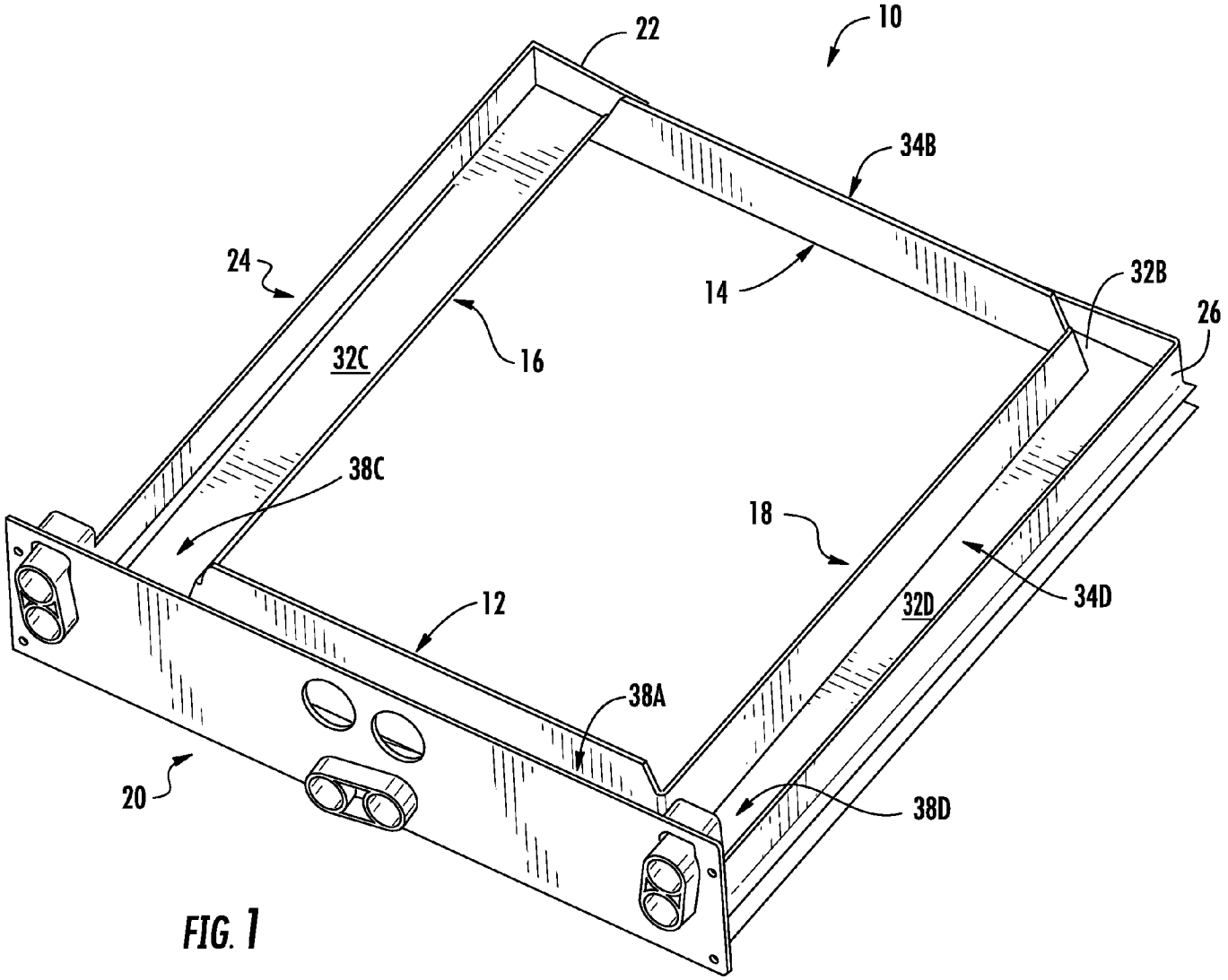
FIG. 1 is a top, front perspective view of a multi-poise condensate drain pan according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2:
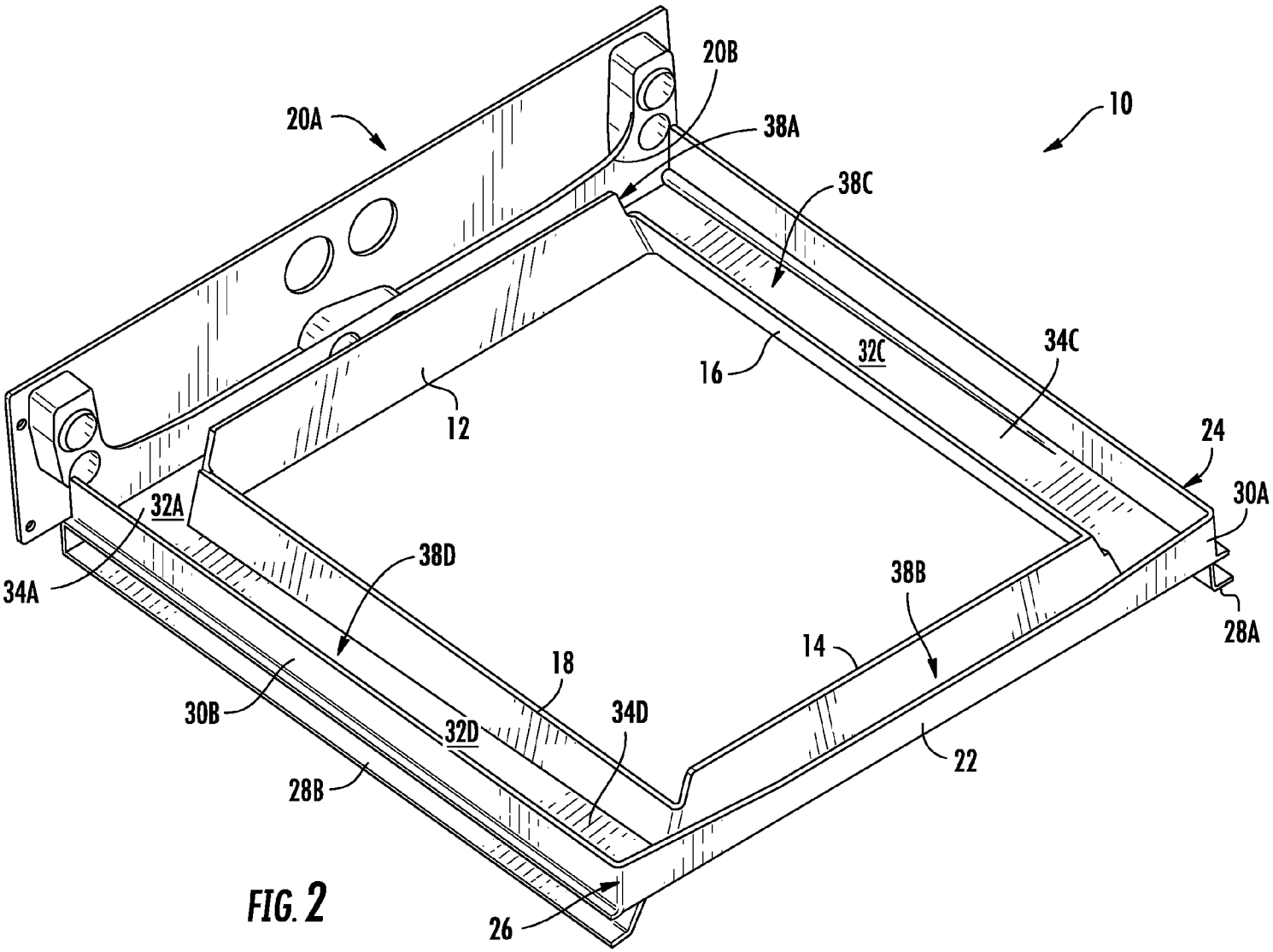
FIG. 2 is a top, rear perspective view of a multi-poise condensate drain pan according to at least one embodiment of the present disclosure.

FIGS. 1 and 2 illustrate a condensate drain pan, generally referenced at 10. The condensate drain pan 10 includes an inner front wall 12, an inner back wall 14, and opposing inner side walls 16 and 18 defining an inner perimeter. The condensate drain pan 10 further includes at least one outer front wall 20, an outer back wall 22, and opposing outer side walls 24 and 26 defining an outer perimeter. In at least one embodiment, each opposing outer side wall 24 and 26 includes a respective channel portion 28A-B, configured to engage a mounting rail (not shown), and a wall portion 30A-B extending from the channel portion 28A-B. Each of the channel portions 28A-B may be used to engage a mounting rail for ease of installation of the condensate drain pan 10. The condensate drain pan 10 further includes at least one drain pan panel 32 extending between the inner perimeter and the outer perimeter to form at least one condensate channel 38 configured to collect water therein. In the illustrated embodiment, the drain pan panel 32 comprises drain pan panels 32A-D, including respective panel interior sides 34A-D and panel exterior sides 36A-D extending between the inner perimeter and the outer perimeter to form respective condensate channel 38A-D configured to collect water therein. In at least one embodiment, a front drain pan panel 32A may extend between the inner front wall 12 and the at least one outer front wall 20 to form a front condensate channel 38A. In at least one embodiment, a back drain pan panel 32B may extend between the inner back wall 14 and the outer back wall 22 to form a back condensate channel 38B. In at least one embodiment, a first side drain pan panel 32C may extend between the inner side wall 16 and the outer side wall 24 to form a first side condensate channel 38C. In at least one embodiment a second side drain pan panel 32D may extend between the inner side wall 18 and the opposing outer side wall 26 to form a second side condensate channel 38D.

Figure 3:
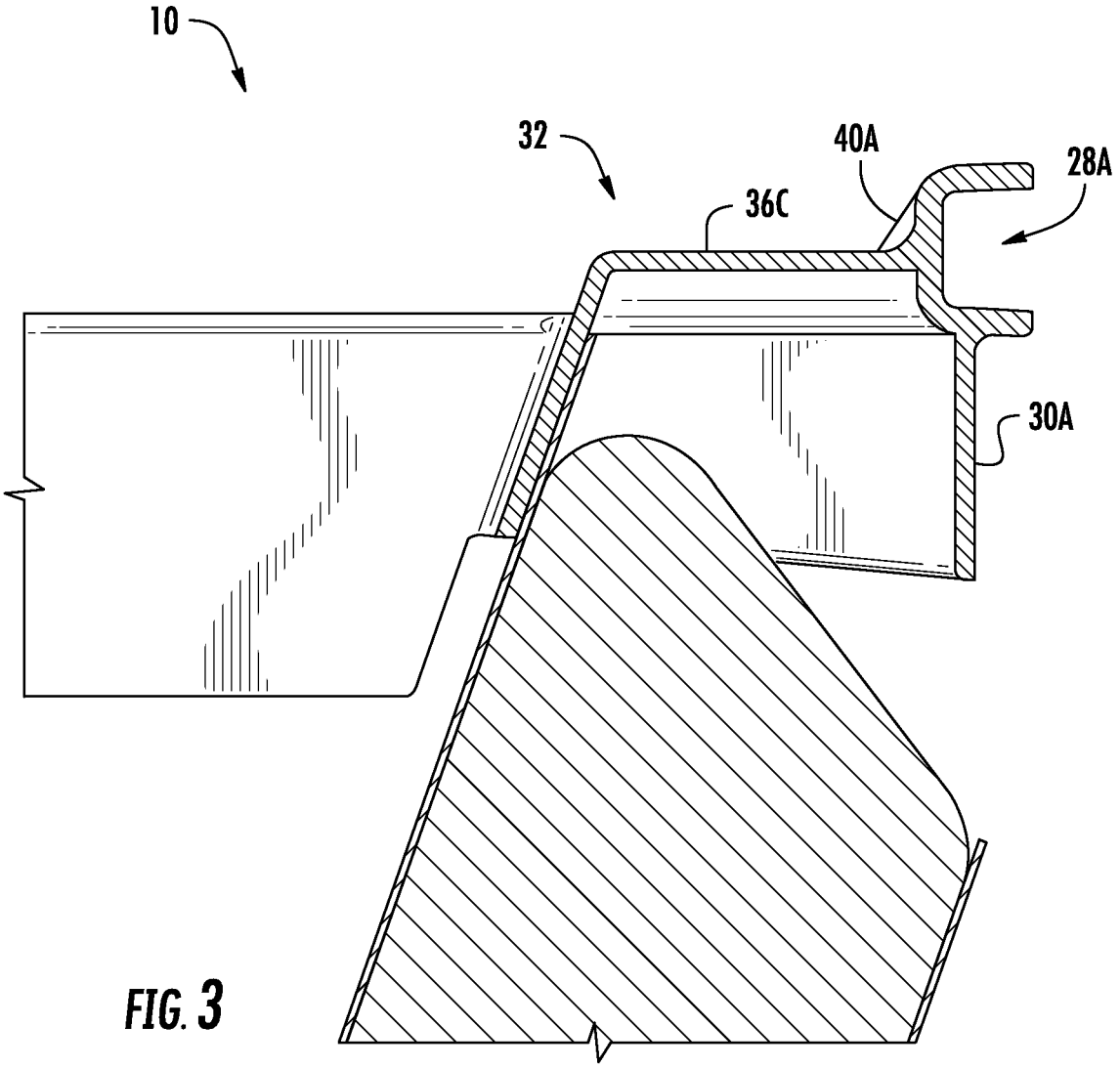
FIG. 3 is a cross-sectional view of a coil positioned within a multi-poise condensate drain pan according to at least one embodiment of the present disclosure.

In at least one embodiment, as shown in FIG. 3, the at least one drain panel 32 extends from a portion of the channel portion 28 to form a lip 40. For example, the first side drain panel exterior side 36C and a portion of the channel portion 28A may form a first lip 40A, and the second side drain panel exterior side 36D and a portion of the channel portion 28B may form a second lip (not shown).

Figure 4:
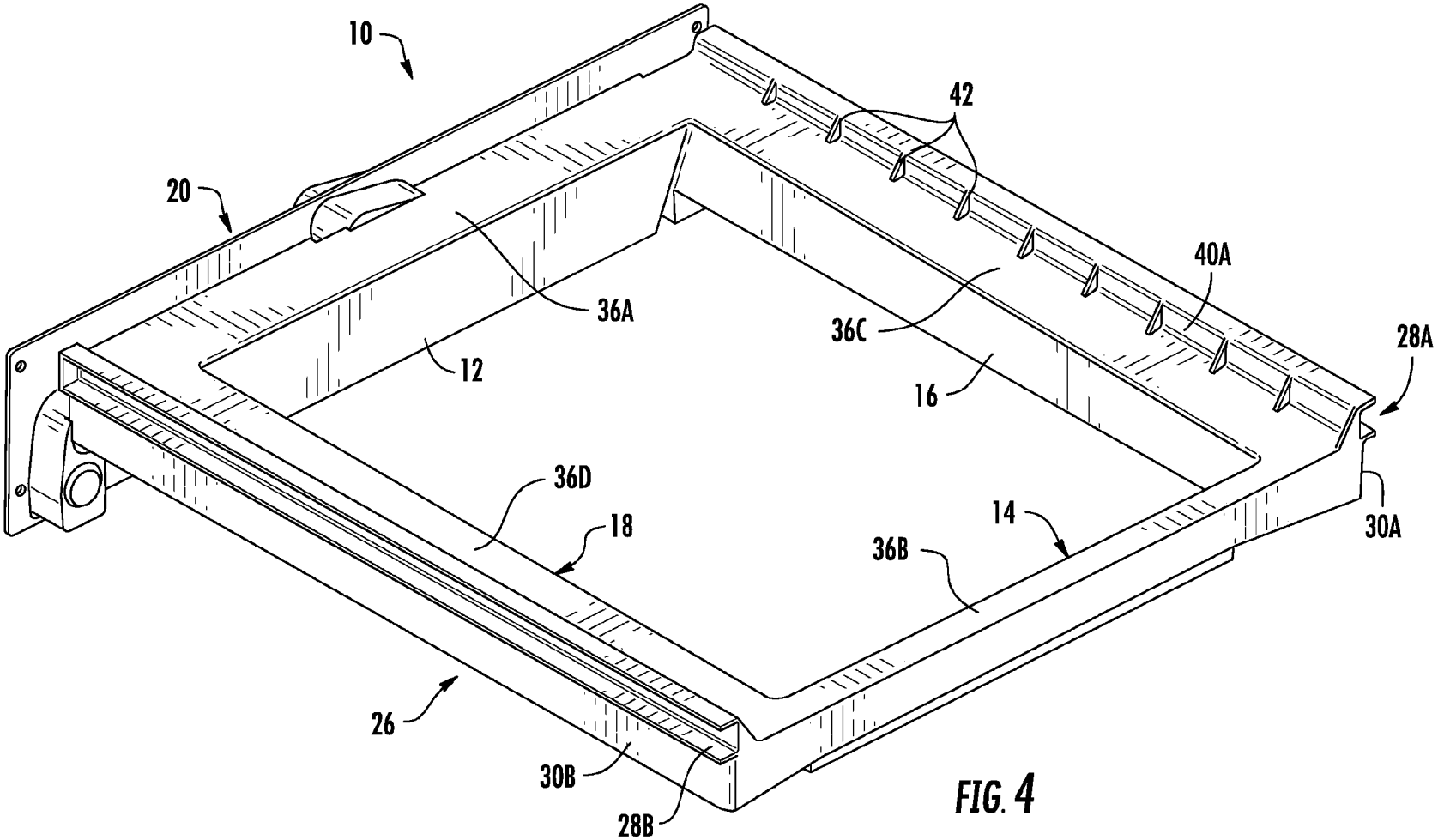
FIG. 4 is a bottom perspective view of a multi-poise condensate drain pan according to at least one embodiment of the present disclosure.

In at least one embodiment, as shown in FIG. 4, at least one tab 42 may extend from the lip 40 to the at least one drain panel exterior side 36. The at least one tab 42 may be configured to improve air flow across the condensate drain pan 10. For example, tab 42 may extend from the first lip 40A to the first side drain panel exterior side 36C, and at least one tab 42 may extend from the second lip (not shown) to the second side drain panel exterior side 36D.

Figure 5:
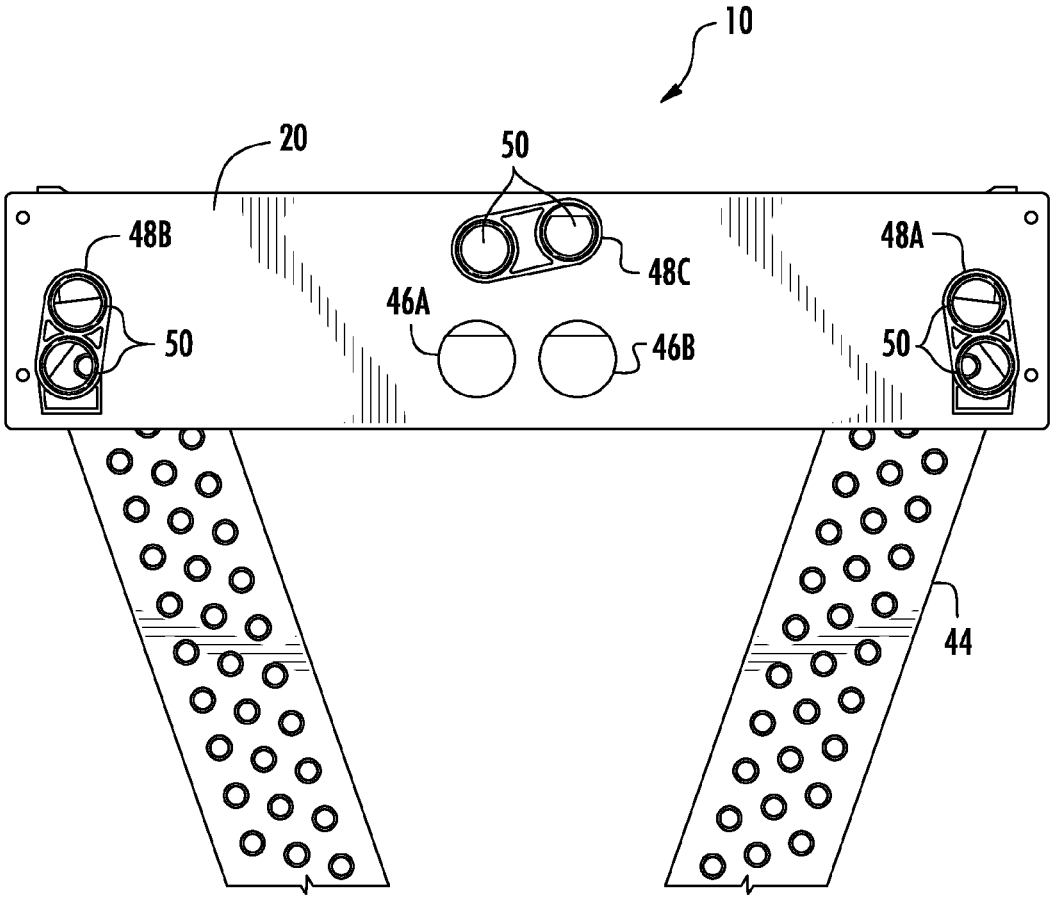
FIG. 5 is a front view of a coil positioned within a multi-poise condensate drain according to at least one embodiment of the present disclosure.

FIG. 5 illustrates a front view of a coil 44 positioned within the condensate drain pan 10 according to at least one embodiment. The at least one outer front wall 20 includes at least one coil conduit aperture 46A-B disposed therein and configured to allow a coil conduit (not shown) to be inserted therethrough. The at least one coil conduit apertures 46A-B are configured to allow a suction conduit and a liquid conduit of an evaporator coil to pass therethrough to eliminate the need for an additional access panel to maintain or service the evaporator coil.

The condensate drain pan 10 further includes at least one drain opening 48 disposed in the at least one outer front wall 20, the at least one drain opening 48 being operable to drain water from the condensate channels 38A-D into a drain line (not shown) coupled to the at least one drain opening 48. The at least one drain openings 48 may be configured to drain condensate from a coil whether the coil is positioned in a downflow, horizontal left or horizontal right configuration without the need for a separate drain pan. For example, the condensate drain pan 10 may include three drain openings 48A-C. It will be appreciated that any number of drain openings 48 may be used. In one embodiment, the at least one drain opening 48 includes at least one drain aperture 50 substantially aligned with the first side condensate channel 38C. For example, drain opening 48A may be substantially aligned with the first side condensate channel 38C to allow water to drain therefrom when a fan coil assembly 60, later described herein, may be in a horizontal right configuration. In one embodiment, the at least one drain opening 48 includes at least one drain aperture 50 substantially aligned with the second side condensate channel 38D. For example, drain opening 48B may be substantially aligned with the second side condensate channel 38D to allow water to drain therefrom when the fan coil assembly 60 may be in a horizontal left configuration. In one embodiment, the at least one drain opening 48 includes at least one drain aperture 50 substantially aligned with the front condensate channel 38A. For example, drain opening 48C may be substantially aligned with the front condensate channel 38A to allow water to drain therefrom when the fan coil assembly 60 may be in downflow configuration.

Figure 6:
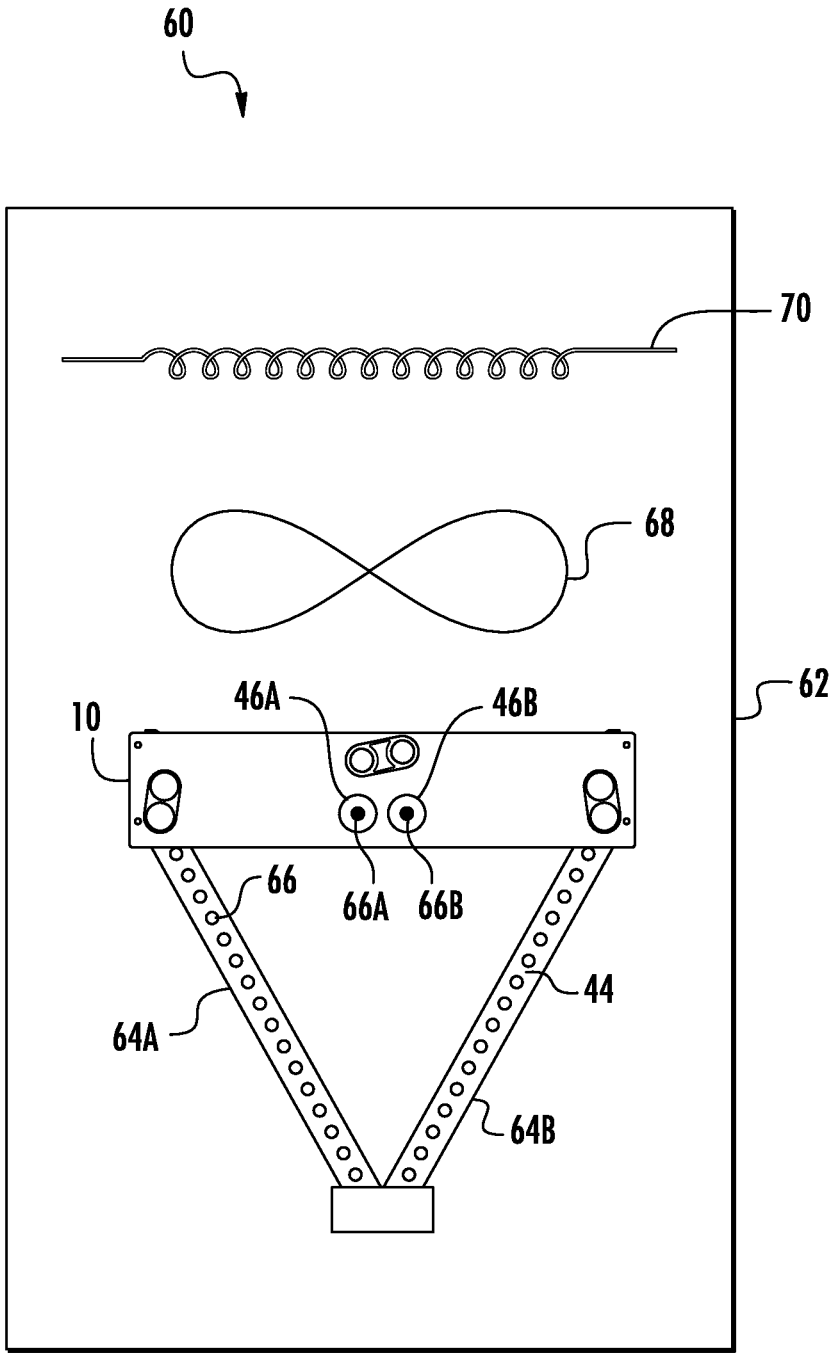
FIG. 6 is a front view of a fan coil assembly according to at least one embodiment of the present disclosure.

FIG. 6 illustrates a front view of a fan coil assembly, generally referenced at 60. The fan coil assembly 60 includes a coil 44 disposed within a casing 62 wherein the coil 44 may be configured to allow a liquid to flow therethrough. The coil 44 includes at least one coil slab 64 and at least one coil conduit 66 disposed within and protruding from the at least one coil slab 64. It will be appreciated that the at least one coil slab 64 may be configured in an "A" or a "V" orientation to name a couple of non-limiting examples. For example, a liquid may be allowed to enter the coil 44 through a first coil conduit 66A, flow through the at least one coil slabs 64A and 64B; then, exit through a second coil conduit 66B when responding to a demand for conditioning an interior space. The coil 44 may be composed of copper or aluminum, and arranged in a tube and fin configuration, to name just a few non-limiting examples. It will be appreciated that the coil 44 may include any suitable number of rows of tubes, for example, two or three to name two non-limiting examples. The fan coil assembly 60 further includes the condensate drain pan 10 positioned to receive at least a portion of condensate from the coil 44. For example, the at least one coil conduits 66A and 66B may be inserted through the at least one coil conduit apertures 46A-B, an end of the at least one coil slab 64A may be aligned with the first side condensate channel 38C, and an end of the at least one coil slab 64B may be aligned with the second side condensate channel 38D.

In one embodiment, the fan coil assembly 60 further includes a fan 68, configured to circulate air across the coil 44 disposed within the casing 62. Fan 68 may be a brushless direct-current powered axial fan, to name just one non-limiting example. In one embodiment, the fan coil assembly 60 further includes an auxiliary heating assembly 70 operably coupled to the casing 62. It will be appreciated that the auxiliary heating assembly 70 may be disposed within the casing 62. The auxiliary heating assembly 70 may be configured to provide supplemental heat to an interior space. For example, the auxiliary heating assembly 70 may be a nickel chromium conductive wire or a secondary heating coil configured to allow heater water to flow therethrough to name a couple of non-limiting examples.

Figure 7:
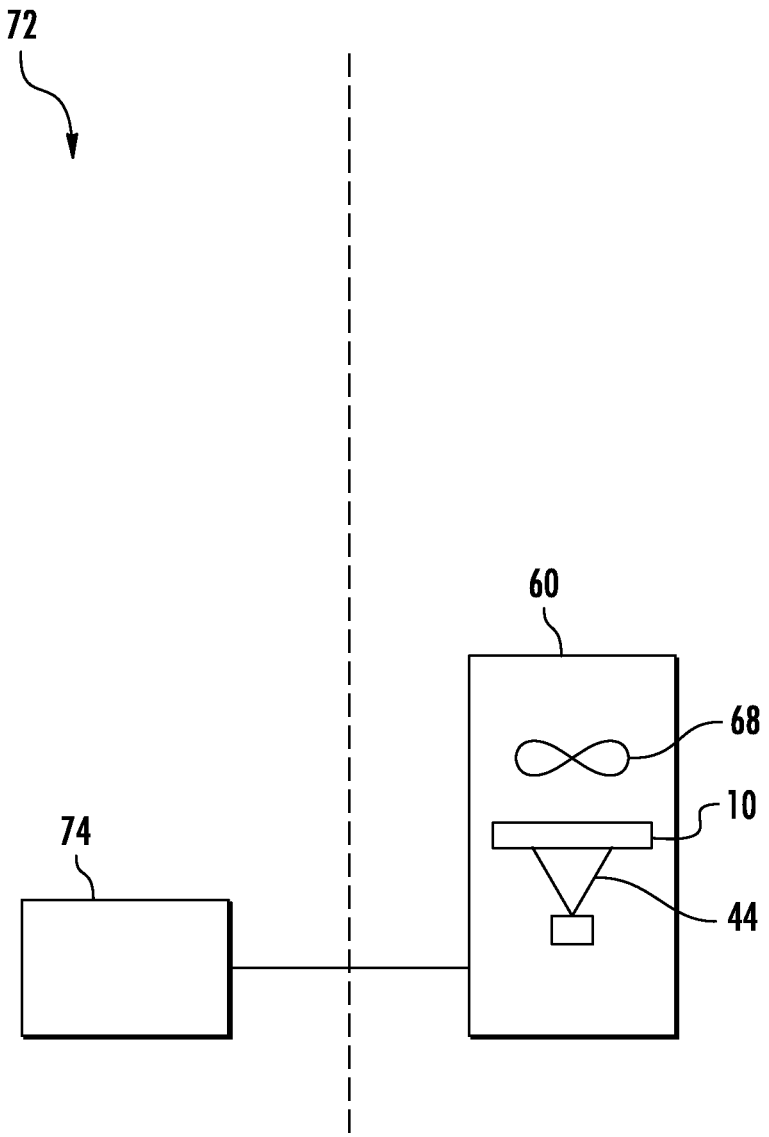
FIG. 7 is a schematic component diagram of an HVAC system according to at least one embodiment of the present disclosure.

FIG. 7 illustrates an embodiment of a heating, ventilation, and air-conditioning (HVAC) system, generally indicated at 72. The HVAC system 72 includes a heat pump 74 operably coupled to the fan coil assembly 60, wherein the fan coil assembly 60 includes a condensate drain pan 10 positioned to receive at least a portion of condensate from the coil 44. The HVAC system 72 may be configured to provide heating and cooling within an interior space.

It will be appreciated that the condensate drain pan 10 includes at least one coil conduit aperture 46 disposed in the outer front wall 20 to allow at the least one coil conduit 66 to be inserted therethrough; thus, eliminating the need for an additional access point and easier access to the coil 44. It will also be appreciated that the condensate drain pan 10 includes channel portions 28A-B to enable ease of installation of the coil 42. It will also be appreciated that the condensate drain pan 10 includes at least one drain opening 48 disposed in the outer front wall 20 to allow condensate to drain from the coil 44 when the fan coil assembly 60 is in either a horizontal or downflow orientation.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A condensate drain pan comprising:

an inner front wall, an inner back wall and opposing inner side walls defining an inner perimeter;

at least one outer front wall, an outer back wall and opposing outer side walls defining an outer perimeter of the condensate drain pan;

at least one drain pan panel, including a panel interior side and a panel exterior side, extending between the inner perimeter and the outer perimeter to form at least one condensate channel;

at least one drain opening disposed in the at least one outer front wall; and at least one coil conduit aperture disposed in the at least one outer front wall and configured to allow a conduit to be inserted therethrough.

2. The condensate drain pan of claim 1, wherein each of the opposing outer side walls comprises a channel portion and a wall portion extending from the channel portion.

3. The condensate drain pan of claim 2, wherein the at least one drain panel extends from the channel portion to form a lip therebetween.

4. The condensate drain pan of claim 1, wherein the at least one condensate channel includes a front condensate channel including a front drain pan panel extending between the inner front wall and the at least one outer front wall.

5. The condensate drain pan of claim 4, wherein the at least one drain opening comprises at least one drain aperture substantially aligned with the front condensate channel.

6. The condensate drain pan of claim 1, wherein the at least one condensate channel includes a back condensate channel including a back drain pan panel extending between the inner back wall and the outer back wall.

7. The condensate drain pan of claim 1, wherein the at least one condensate channel includes a first side condensate channel including a first side drain pan panel extending between one of the opposing inner side walls and one of the opposing outer side walls.

8. The condensate drain pan of claim 7, wherein the at least one condensate channel includes a second side condensate channel including a second side drain pan panel extending between the other opposing inner side wall and the other opposing outer side wall.

9. The condensate drain pan of claim 7, wherein the at least one drain opening comprises at least one drain aperture substantially aligned with the first side condensate channel.

10. The condensate drain pan of claim 8, wherein the at least one drain opening comprises at least one drain aperture substantially aligned with the second side condensate channel.

11. The condensate drain pan of claim 3, wherein at least one tab extends from the lip to the exterior side of the at least one drain panel.

12. A fan coil assembly comprising:

a casing;

a coil disposed within the casing, wherein the coil comprises at least one coil slab, and at least one coil conduit disposed in and protruding from the at least one coil slab;

a condensate drain pan positioned to receive at least a portion of condensate from the coil, wherein the condensate drain pan comprises an inner front wall, an inner back wall and opposing inner side walls defining an inner perimeter;

at least one outer front wall, an outer back wall and opposing outer side walls defining an outer perimeter of the condensate drain pan;

at least one drain pan panel, including a panel interior side and a panel exterior side, extending between the inner perimeter and the outer perimeter to form at least one condensate channel;

at least one drain opening disposed in the at least one outer front wall; and at least one coil conduit aperture disposed in the at least one outer front wall and configured to allow the at least one coil conduit to be inserted therethrough.

13. The fan coil assembly of claim 12, further comprising a fan disposed in the casing.

14. The fan coil assembly of claim 12, further comprising an auxiliary heating assembly operably coupled to the casing.

15. The fan coil assembly of claim 12, wherein each of the opposing outer side walls comprises a channel portion and a wall portion extending from the channel portion.

16. The fan coil assembly of claim 15, wherein the at least one drain panel extends from the channel portion to form a lip therebetween.

17. The fan coil assembly of claim 16, wherein at least one tab extends from the lip to the exterior side of the at least one drain panel.

18. The fan coil assembly of claim 12, wherein the at least one condensate channel includes a front condensate channel including a front drain pan panel extending between the inner front wall and the at least one outer front wall.

19. The fan coil assembly of claim 18, wherein the at least one drain opening comprises at least one drain aperture substantially aligned with the front condensate channel.

20. The fan coil assembly of claim 12, wherein the at least one condensate channel includes a back condensate channel including a back drain pan panel extending between the inner back wall and the outer back wall.

21. The fan coil assembly of claim 12, wherein the at least one condensate channel includes a first side condensate channel including a first side drain pan panel extending between one of the opposing inner side walls and one of the opposing outer side wall.

22. The fan coil assembly of claim 21, wherein the at least one condensate channel includes a second side condensate channel including a second side drain pan panel extending between the other opposing inner side wall and the other opposing outer side wall.

23. The fan coil assembly of claim 21, wherein the at least one drain opening comprises at least one drain aperture substantially aligned with the first side condensate channel.

24. The fan coil assembly of claim 22, wherein the at least one drain opening comprises at least one drain aperture substantially aligned with the second side condensate channel.

25. An HVAC system comprising:

a fan coil assembly operably coupled to a heat pump, wherein the fan coil assembly comprises:

a coil and a fan disposed in a casing;

a condensate drain pan positioned to receive at least a portion of condensate from the coil, wherein the condensate drain pan comprises:

an inner front wall, an inner back wall and opposing inner side walls defining an inner perimeter;

at least one outer front wall, an outer back wall and opposing outer side walls defining an outer perimeter of the condensate drain pan;

at least one drain pan panel, including a panel interior side and a panel exterior side, extending between the inner perimeter and the outer perimeter to form at least one condensate channel;

at least one drain opening disposed in the at least one outer front wall; and at least one coil conduit aperture disposed in the at least one outer front wall and configured to allow a conduit to be inserted therethrough.

26. The HVAC system of claim 25, wherein each of the opposing outer side walls comprises a channel portion and a wall portion extending from the channel portion.

27. The HVAC system of claim 26, wherein the at least one drain panel extends from the channel portion to form a lip therebetween.

28. The HVAC system of claim 25, wherein the at least one condensate channel includes a front condensate channel including a front drain pan panel extending between the inner front wall and the at least one outer front wall.

29. The HVAC system of claim 28, wherein the at least one drain opening comprises at least one drain aperture substantially aligned with the front condensate channel.

30. The HVAC system of claim 25, wherein the at least one condensate channel includes a back condensate channel including a back drain pan panel extending between the inner back wall and the outer back wall.

31. The HVAC system of claim 25, wherein the at least one condensate channel includes a first side condensate channel including a first side drain pan panel extending between one of the opposing inner side walls and one of the opposing outer side wall.

32. The HVAC system of claim 31, wherein the at least one condensate channel includes a second side condensate channel including a second side drain pan panel extending between the other opposing inner side wall and the other opposing outer side wall.

33. The HVAC system of claim 31, wherein the at least one drain opening comprises at least one drain aperture substantially aligned with the first side condensate channel.

34. The HVAC system of claim 32, wherein the at least one drain opening comprises at least one drain aperture substantially aligned with the second side condensate channel.

35. The HVAC system of claim 27, wherein at least one tab extends from the lip to the exterior side of the at least one drain panel.

* * * * *